US007644801B2

(12) United States Patent
Klein et al.

(10) Patent No.: US 7,644,801 B2
(45) Date of Patent: Jan. 12, 2010

(54) MEMBRANE WITH A HIGH RESISTANCE AGAINST BUCKLING AND/OR CRINKLING

(75) Inventors: Erich Klein, Himberg (AT); Ewald Frasl, Biedermannsdorf (AT); Susanne Windischberger, Vienna (AT)

(73) Assignee: NXP B.V., Eindhoven (NL)

( * ) Notice: Subject to any disclaimer, the term of this patent is extended or adjusted under 35 U.S.C. 154(b) by 217 days.

(21) Appl. No.: 11/908,288

(22) PCT Filed: Mar. 1, 2006

(86) PCT No.: PCT/IB2006/050633

§ 371 (c)(1),
(2), (4) Date: Sep. 10, 2007

(87) PCT Pub. No.: WO2006/095280

PCT Pub. Date: Sep. 14, 2006

(65) Prior Publication Data

US 2008/0202845 A1 Aug. 28, 2008

(30) Foreign Application Priority Data

Mar. 10, 2005 (EP) ..... 05101861

(51) Int. Cl.
*H04R 7/06* (2006.01)
*H04R 7/10* (2006.01)
*G10K 13/00* (2006.01)
*H04R 9/06* (2006.01)

(52) U.S. Cl. ..... 181/157; 181/167; 381/426

(58) Field of Classification Search ..... 181/157, 181/167, 170; 381/426, 423
See application file for complete search history.

(56) References Cited

U.S. PATENT DOCUMENTS 4,029,171 A * 6/1977 Manger ..... 181/167
4,140,203 A * 2/1979 Niguchi et al. ..... 181/167
4,550,797 A * 11/1985 Suzuki et al. ..... 181/167
5,162,619 A * 11/1992 Thiele et al. ..... 181/166

(Continued)

FOREIGN PATENT DOCUMENTS

WO WO8900372 A1 1/1989

OTHER PUBLICATIONS

Hornung; et al "Optimization of Micromachined Ultrasound Transducer by Finite Element Simulation" Proceedings of the International Solid-State Sensors and Actuators Conference—Transducers '95, vol. 2, Jun. 25, 1995, pp. 620-623 Stockholm, Sweden.

(Continued)

*Primary Examiner*—Edgardo San Martin

(57) ABSTRACT

A membrane (2) for an electroacoustic transducer (1) is disclosed, wherein a thickness (d) of said membrane (2) and an average Young's modulus (Eavg) of said membrane (2) are chosen in such a way that the critical load (Fbc), which causes the membrane (2) to buckle and/or crinkle, is increased compared to a reference membrane. The reference membrane made of Polycarbonate has the same shape, dimension, and stiffness in its direction of movement (MOV) as said membrane (2). According to the result of investigations on buckling and/or crinkling, said effect occurs with different critical buckling/crinkling loads for membranes of the same shape and dimension, but made of different materials, even when the stiffness of the membranes in their direction of movement—and hence their resonant frequency—is identical.

8 Claims, 2 Drawing Sheets

U.S. PATENT DOCUMENTS

| | | | | |
|---|---|---|---|---|
| 5,259,036 | A | 11/1993 | Seeler | |
| 5,793,002 | A * | 8/1998 | Sato et al. | 181/169 |
| 6,154,556 | A | 11/2000 | Takahashi et al. | |
| 6,390,232 | B1 * | 5/2002 | Kirschbaum | 181/169 |
| 6,570,995 | B2 * | 5/2003 | Ohashi et al. | 381/430 |
| 7,092,544 | B2 * | 8/2006 | Hachiya et al. | 381/426 |
| 7,306,073 | B2 * | 12/2007 | Frasl | 181/173 |
| 7,344,001 | B2 * | 3/2008 | Inoue et al. | 181/169 |
| 7,416,047 | B2 * | 8/2008 | Frasl et al. | 181/173 |
| 2005/0078850 | A1 * | 4/2005 | Norton | 381/423 |
| 2005/0084131 | A1 * | 4/2005 | Fordham et al. | 381/431 |
| 2006/0222202 | A1 * | 10/2006 | Uryu et al. | 381/426 |
| 2007/0260019 | A1 * | 11/2007 | Ohme et al. | 525/400 |
| 2008/0285778 | A1 * | 11/2008 | Kuroda et al. | 381/152 |

OTHER PUBLICATIONS

Barlow; et al "The Resonances of Loudspeaker Diaphragms" Journal of the Audio Engineering Society, New York, NY, vol. 29, No. 10, Oct. 1981 pp. 699-704.

* cited by examiner

MEMBRANE WITH A HIGH RESISTANCE AGAINST BUCKLING AND/OR CRINKLING

FIELD OF THE INVENTION

The invention relates to a membrane for an electroacoustic transducer, to an electroacoustic transducer having an inventive membrane, as well as to a device having an inventive transducer.

BACKGROUND OF THE INVENTION

The ever increasing requirements on electroacoustic transducers, meaning increased sound pressure and sound quality at a decreased size of said transducers, lead to certain problems, wherein the membrane, which is a very important part, represents one of them. For good sound reproduction, on the one hand, a low resonant frequency of the membrane should be obtained, which means that thin membranes made of soft materials should be chosen. High sound pressures, on the other hand, demand relatively thick and stiff membranes. So there are opposite basic requirements for a membrane, which are to be balanced and which define a limit to what is technically possible. Nowadays transducers using membranes made of common materials such as Polycarbonate (PC), Polyetherimide (PEI), Polyethylenterephthalate (PET), or Polyethylennaphtalate (PEN), have reached this borderline, which is to be broken through.

To explain the aforesaid problems in more detail, reference is now made to FIG. 1, which shows a simplified cross section of a speaker 1. The speaker 1 comprises a membrane 2, a coil 3 attached to said membrane 2, a magnetic system 4 interacting with the coil 3, and a housing 5, which keeps the aforesaid parts together. The membrane 2 has a certain thickness d and together with housing 5 forms a back volume Vb. Membrane 2 normally also comprises corrugations, which enable its movement, which corrugations are left in this and further drawings for the sake of brevity.

FIG. 2 now shows the movement of the membrane 2. Membrane 2 may move in the direction of movement MOV. Thin lines indicate its lower dead center and its upper dead center. The distance of movement s of the membrane 2 is measured in direction of movement MOV, wherein a positive distance of movement s indicates an upward movement, a negative one a downward movement.

FIG. 3 shows differential operating loads dFo acting on the membrane 2. The coil 3, which is not shown, forces the membrane 2 to move up and down. Integration of all differential operating loads dFo results in an overall operating load Fo, which is to be produced by the magnetic force between coil 3 and magnetic system 4. Loads F directed upwards are positive, those directed downwards are negative.

FIG. 4 shows a differential part 2dp of membrane 2 (see also dotted circle in FIG. 3). As it has a differential mass dm, an acceleration—a downwards causes a differential accelerating force dFa to go up:

$$dF_a = a \cdot dm = \omega^2 \cdot s_{max} \cdot dm = 2 \cdot \pi \cdot f^2 \cdot s_{max} \cdot dm$$

wherein ω is angular velocity and f is the frequency of the membrane 2 and wherein smax is the maximum amplitude of the membrane 2. At the same time a differential pressure force dFp is acting on the differential part 2dp, since it is assumed that the membrane 2 is below its idle position in FIG. 4. Thus the back volume Vb is compressed, causing a positive pressure force dFp acting perpendicularly on the membrane 2 according to the adiabatic gas equation $$p \cdot V^{\kappa} = \text{const}$$

wherein p is a pressure, V is a volume and K is the adiabatic coefficient (for air under standard conditions κ=1.402). Hence an increase of the volume V leads to a decrease of the pressure p and vice versa. Therefore, the pressure p in the back volume Vb decreases when the membrane 2 moves upwards. The differential pressure force dFp may now be calculated as follows $$dF_p = p \cdot dA = p_0 \cdot \left(\frac{Vb_0}{Vb}\right)^{\kappa} \cdot dA$$

wherein dA is a differential area of the differential part 2dp, Vb0 and p0 are the back volume of the transducer 1 and the pressure therein at the membrane's idle position.

Both, the differential accelerating force dFa and the differential pressure force dFp form the differential operating load dFo. The latter one causes the membrane 2 to be bent. The elasticity of the membrane, defined by the Young's modulus E of the membrane 2, transversal to its extension of thickness d, acts against this bending (see also Eavg in FIG. 7 for the definition of said direction). Hence a certain operating load Fo leads to a certain movement of the membrane 2.

FIG. 5 now shows the distance of movement s of the membrane 2 as well as the differential loads dF acting on the membrane 2 over time. It is assumed that a sinusoidal current flows through the coil 3. Hence the membrane 2 moves sinusoidally as well, visualized by the graph for the distance of movement s (solid thin line). The differential accelerating force dFa (dash-and-dot line) is sinusoidal as well, as it is directed opposite to the acceleration a, which is the second derivation of the distance of movement s. In contrast to that is the differential pressure force dFp (dashed line), which is at its negative maximum in the upper dead center of the membrane 2. Both the differential accelerating force dFa and the differential pressure force dFp forms the differential operating load dFo (solid bold line) as stated before. Since membranes in general are relatively lightweight and sound pressure is relatively high (meaning that the amplitude of the membrane's movement is also high), the differential pressure force dFp is higher than the differential accelerating force dFa. Since both are in phase, the differential operating load dFo shows an in-phase negative sinusoidal graph. The same applies to overall loads, meaning that the differential loads may be integrated over the whole membrane 2 or at least over part of said membrane 2.

FIG. 6 now shows the membrane 2 in its idle position as well as in its upper dead center (thin dashed line). As long as the operating load Fo is below a so-called critical buckling/crinkling load Fbc, the dome of the membrane 2, which is the part of the membrane 2 inside the coil 3, substantially keeps its shape. At the least it is bent outwards. When the operating load Fo exceeds the critical buckling/crinkling load Fbc, the dome of the membrane 2 snaps inwards due to the so-called buckling and/or crinkling effect (thin solid line).

The same applies to the border area of the membrane 2 outside the coil 3 as well. Normally it is bent outwards, but at a certain load it may snap inwards. This effect is quite complex and highly depends on the shape of the membrane 2. A higher dome for instance would buckle much later than a flat one. Corrugations too, which are normally part of a membrane but which were left out for the sake of brevity here, highly influence this buckling and/or crinkling. Thus this effect may also be limited to a relatively small area of the membrane 2, for example if there are sharp edges or intersections, which essentially influence the mechanical behavior of the membrane 2. Because of the complexity of the buckling/crinkling effect, it is only possible to calculate where and when buckling/crinkling occurs by the use of computer simulation using the finite elements method.

In any case the aforesaid buckling and/or crinkling is an unwanted effect because it dramatically draws down the acoustic quality of a transducer as can easily be imagined. Membrane 2 is to compress the air in front of the transducer in its upper position, whereas it more or less decompresses the air, when the membrane 2 buckles. So the sound wave does not show a sinusoidal graph anymore, although the current in the coil 3 does. This is unacceptable for present-day requirements.

To explain the balancing problem of sound quality and sound pressure, which was briefly mentioned in the first paragraph of the "background of the invention" in more detail, reference is now made to basic formulas for the resonant frequency and for the stiffness of a membrane (meaning its resistance against movement in direction of movement or its spring constant):

$$f_{res}=k_1\cdot d\cdot\sqrt{E}$$

According to the first formula the resonant frequency fres of a membrane depends on a first form factor k1, the thickness d of the membrane and the Young's modulus E of the membrane. Since there is a tendency to decrease the resonant frequency fres, so as to increase the acoustic performance of a transducer, there is also a tendency to reduce the thickness d of the membranes. This leads to a drawback as the stiffness S of a membrane in its direction of movement is proportional to the square of the resonant frequency.

$$S\propto f_{res}^2=k_1^2\cdot d^2\cdot E$$

It can easily be seen that a reduction of the thickness d and thus a reduction of resonant frequency fres results in a decrease of the stiffness S. A lower stiffness S in turn results in a decreased maximum possible sound pressure and an increased tendency for buckling/crinkling, which is undesired. So one could try to increase the Young's modulus E accordingly. But reaching the same stiffness S (and according to former investigations hence also the same tendency for buckling/crinkling) means also reaching the same resonant frequency fres again, which results in a degraded sound quality. The same applies to one who would decrease Young's modulus E and increase thickness d.

To illustrate this fact, a simple example is given. To improve sound quality an engineer reduces the thickness s of the membrane by half. Accordingly, the resonant frequency fres is also halved. Looking at the stiffness S he realizes that stiffness S is only one fourth. Hence he chooses a material having a Young's modulus E four times higher to keep the same stiffness S, but evaluating the formula for the resonant frequency fres again, he realizes that the resonant frequency fres which was halved originally is doubled and hence the same as at the start.

According to the aforesaid formulas there is no material to be expected which would lead to a breakthrough, meaning increasing sound quality (by reducing resonant frequency fres) and increasing sound pressure (by increasing stiffness S) at the same time, even when a harder material is chosen. Therefore, known materials simply have been kept, so that normally Polycarbonate (PC), Polyetherimide (PEI), Polyethylentrephthalate (PET), or Polyethylennaphtalate (PEN) have been used for membranes for example.

These materials define a technical borderline, because they only allow certain combinations of sound quality and sound pressure. Beyond this borderline buckling and/or crinkling occurs, meaning that the operating load Fo exceeds the critical buckling/crinkling load Fbc. To develop improved transducers this borderline is to be crossed.

OBJECT AND SUMMARY OF THE INVENTION

Hence it is an object of this invention to prevent a membrane from buckling and/or crinkling.

This object is achieved by a membrane for an electroacoustic transducer, wherein a thickness of said membrane and an average Young's modulus of said membrane, transversal to its extension of thickness, are chosen in such a way, that the critical load, which causes at least part of the membrane to buckle and/or crinkle, is increased, compared to a reference membrane made of Polycarbonate of the same shape, dimension, and stiffness in its direction of movement.

Surprisingly, the buckling and/or crinkling effect occurs at different critical buckling/crinkling loads for membranes of the same shape and dimension, but made of different materials, even when the stiffness of the membranes in their direction of movement is identical. This behavior was not to be predicted so that one does not wonder that there was a stagnation in transducer development. What was found out during extensive experiments and computer simulations is the following formula, which show the influence of basic characteristics of a membrane on the critical buckling/crinkling load Fbc.

$$F_{bc}=k_2\cdot d^x\cdot E$$

The critical buckling/crinkling load Fbc depends on a second form factor k2, the thickness d of the membrane, a third form factor x, which is an exponent of the thickness d, and the Young's modulus E of the membrane. First form factor k1 (from the formula for the resonant frequency fres), second form factor k2 and third form factor x depend on the geometric shape and dimension of a membrane. Due to the complex forms of the membranes it is more or less impossible to give formulas for the values of the factors k1, k2, and x. They can only be determined by computer simulation of a certain membrane.

What the aforesaid formulae show is the following: Starting with a reference membrane made of Polycarbonate, as it has been commonly used for membranes, the resistance against buckling/crinkling can be improved without decreasing its acoustic performance (meaning keeping the resonant frequency fres of the membrane constant) by increasing the thickness d of the membrane and decreasing its Young's modulus E because of the third form factor x, which is always greater than 2. Hence an increase of the critical buckling/crinkling load Fbc has not necessarily led to an increase of the resonant frequency fres. An increased critical buckling/crinkling load Fbc not only allows higher sound pressures, but also flatter domes of the membrane and hence flatter speakers, because the lower the dome, the higher its tendency to buckle/crinkle.

Coming back to our engineer who reduces thickness s of the membrane by half, we see the following. Again the resonant frequency fres is halved, and the stiffness S is only one fourth, but the critical buckling/crinkling load Fbc is higher than only one fourth, just by way of example let us say one third. Hence he chooses a material having a Young's modulus E three times higher to keep the same critical buckling/crinkling load Fbc. Evaluating the formula for the resonant frequency fres again, he realizes that the resonant frequency fres, which was halved originally, is increased by the square root of three and hence lower than at the start.

It should be noted that the invention could also be defined as follows: Membrane for an electroacoustic transducer, wherein a thickness of said membrane and an average Young's modulus of said membrane, transversal to its extension of thickness, are chosen in such a way that the stiffness of the membrane in its direction of movement is decreased, compared to a reference membrane of the same shape, dimension, and critical load, which decrease causes at least part of the reference membrane made of Polycarbonate to buckle and/or crinkle. The only difference here is the way of defining of the technical improvement.

A preferred membrane is now achieved, when the average Young's modulus is lower and the thickness is higher than those of said reference membrane. In this manner the critical buckling/crinkling load may be increased. Apart from the advantages which may be directly derived from the aforementioned formulas, there is an another advantage. Thicker membranes are easier to produce than thinner ones. During the ironing process a piece of raw material is stretched to a multiple of its original extension, reducing the thickness to a fraction at the same time. The higher the ratio between original thickness and thickness of the finished membrane, the more critical it is to obtain similar membranes, since the material characteristics vary. Thus it is preferred to have a lower ratio so as to increase the membrane's reproducibility. The present invention offers the advantage to have relatively thick membranes at an increased sound quality and/or sound pressure.

A preferred membrane is further achieved, when the critical buckling/crinkling load is higher than the operating loads of said transducer on said membrane, which are higher than the critical reference buckling/crinkling load of said reference membrane. This condition defines the secure operating area of a transducer, because the operating loads do not exceed the critical buckling/crinkling load.

It is further advantageous, when said critical buckling/crinkling load of said membrane is 20% lower than that of said reference membrane when defining the invention by means of a variable critical buckling/crinkling load (stiffness constant), and when said stiffness of said membrane is 20% lower than that of said reference membrane when defining the invention by means of variable stiffness (critical buckling/crinkling load constant). In this manner the invention is defined by a certain amount of technical improvement.

Yet another preferred embodiment of the invention is a membrane, wherein the absolute value of the difference of pressure between an environment of said electroacoustic transducer and said back volume of said transducer is higher than 600 Pa (150 dB). Nowadays transducers, for example a speaker in a mobile device such as a mobile phone, often have very small back volumes due to limited space. This results in a dramatic increase of the difference of pressure between the environment of the transducer and its back volume, which can easily be imagined when looking at the adiabatic gas equation. Therefore the present invention in particular refers to transducers having a relatively small back volume and a relatively high sound pressure (meaning a high amplitude of the membrane). A further preferred embodiment of the invention is a membrane, wherein said absolute value is higher than 2000 Pa (160 dB). Finally is of advantage a membrane in which said absolute value is higher than 6000 Pa (170 dB).

It is also advantageous when a material with a Young's modulus of 2.5 GPa is used instead of Polycarbonate for the reference membrane. Since the Young's modulus of Polycarbonate may vary, a definite value for the reference Young's modulus is defined.

Another preferred embodiment of the invention is a membrane, comprising at least two layers of different materials. To achieve a reduction of the Young's modulus it is proposed to use a so-called compound membrane, which consists of various layers of different materials. Very common are compound membranes having outer layers of relatively hard material with a relatively soft material in-between. Usually they are used because of their good damping characteristics. The present invention proposes to use them also to prevent buckling and/or crinkling.

Finally it is also advantageous, when the membrane comprises two outer first layers made of Polyarylate (PAR) or Polycarbonate (PC) and an inner second layer made of an adhesive on acrylic basis. It has been found out during experiments that this combination of materials notably provide the inventive effect. The object of the invention may therefore be achieved by using common materials.

The object of the invention is furthermore achieved by an electroacoustic transducer, comprising an inventive membrane, as well as by a device, comprising an inventive electroacoustic transducer. Advantages and preferred embodiments stated for the inventive membrane apply to the inventive transducer and the inventive device as well.

It should be noted that the invention is related to electroacoustic transducers in general, which means to speakers as well as microphones, even though reference is mostly made to speakers.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 7:
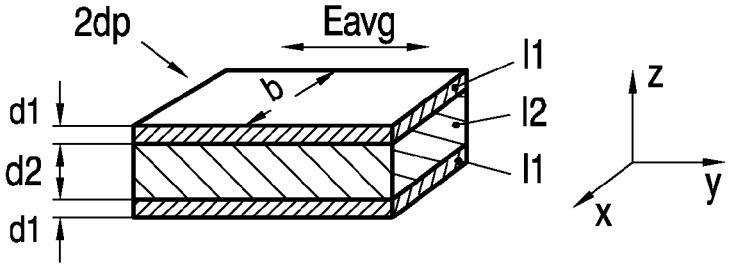
FIG. 7 shows how the average Young's modulus of a membrane may be calculated.

FIG. 7 shows how the average Young's modulus of a membrane 2, transversal to its extension of thickness d (here in y-direction) may be calculated. The membrane 2 is of the so-called compound type. Two first outer layers 11 of a first material enclose a second layer 12 of a second material. For example the first outer layers 11 are made of Polyarylat (PAR) and the inner second layer 12 is made of an adhesive on acrylic basis.

The first layers 11 have a first thickness d1, the second layer 12 a second thickness d2. Moreover, the first material has a first Young's modulus E1, the second material a second Young's modulus E2. The FIG. 7 shows a cuboid, cut out of the membrane 2, with an overall thickness 2·d1+d2, a width w and a length l. The average Young's modulus Eavg of a membrane 2, transversal to its extension of thickness d is calculated in the following: The relative elongation $\epsilon$ in y-direction is the same for all three layers 11, 12, 11. Hence the load contribution of the first layer 11 may be calculated as $$F_1=\sigma_1 \cdot A_1=\epsilon \cdot E_1 \cdot b \cdot d_1$$

Accordingly, the load contribution of the second layer 12 may be calculated as $$F_2=\sigma_2 \cdot A_2=\epsilon \cdot E_2 \cdot b \cdot d_2$$

The overall load is then $$F_{tot}=2 \cdot F_1+F_2=\epsilon \cdot b \cdot (2 \cdot E_1 \cdot d_1+E_2 \cdot d_2)$$

And the overall load is $$F_{tot}=\sigma_{Avg} \cdot A_{tot}=\epsilon \cdot E_{avg} \cdot A_{tot}=\epsilon \cdot E_{avg} \cdot b \cdot (2 \cdot d_1+d_2)$$

Hence the following equation results:

$$\varepsilon \cdot b \cdot (2 \cdot E_1 \cdot d_1 + E_2 \cdot d_2) = \varepsilon \cdot E_{avg} \cdot b \cdot (2 \cdot d_1 + d_2)$$

$$E_{avg} = \frac{2 \cdot E_1 \cdot d_1 + E_2 \cdot d_2}{2 \cdot d_1 + d_2}$$

Figure 8:
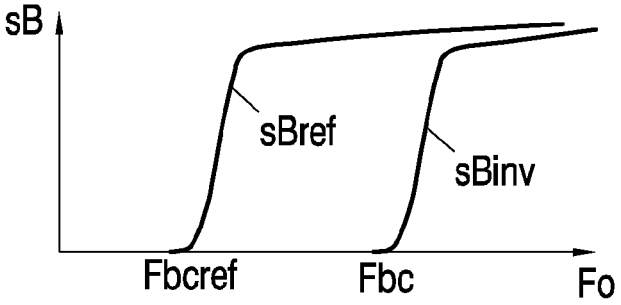
FIG. 8 shows the buckling/crinkling amplitude over the operating loads.

FIG. 8 shows the buckling/crinkling amplitude sB plotted against the operating loads Fo. Two graphs are drawn, a first graph sBref for a reference membrane made of Polycarbonate and a second one sBinv for a inventive membrane 2.

Figure 1:
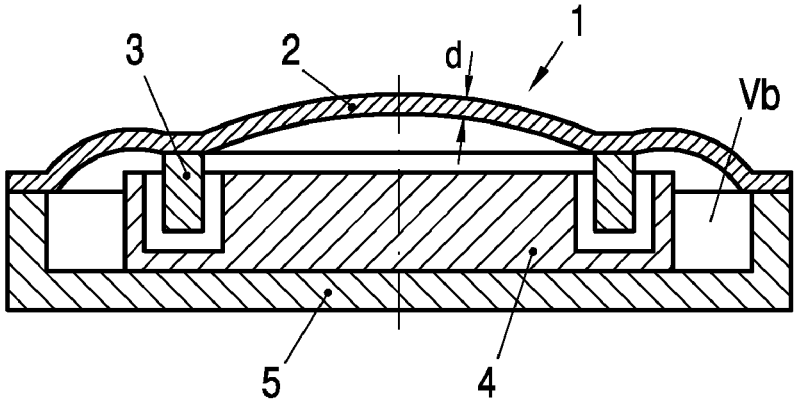
FIG. 1 shows a simplified cross section of a speaker.
Figure 2:
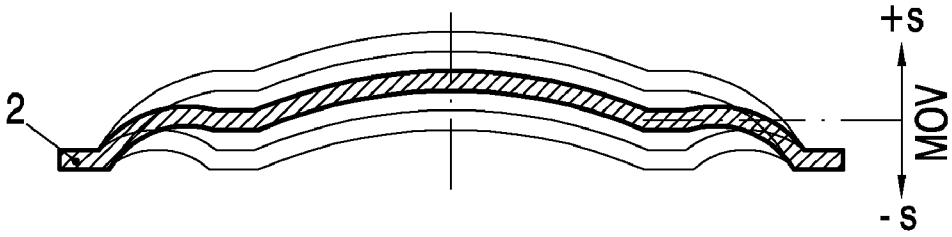
FIG. 2 shows the movement of a speaker's membrane.
Figure 3:
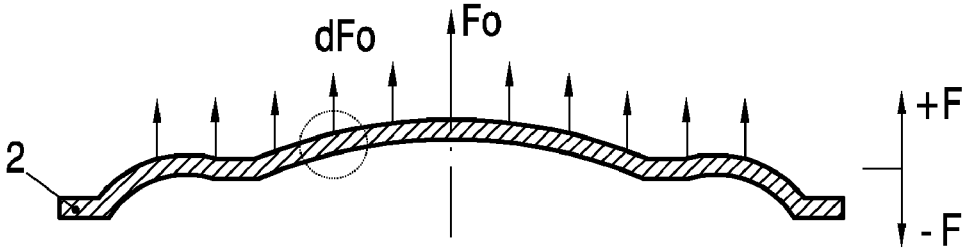
FIG. 3 shows differential operating loads acting on a membrane.
Figure 4:
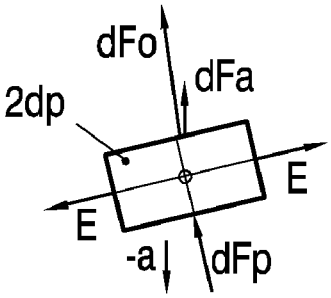
FIG. 4 shows an differential part of a membrane.
Figure 5:
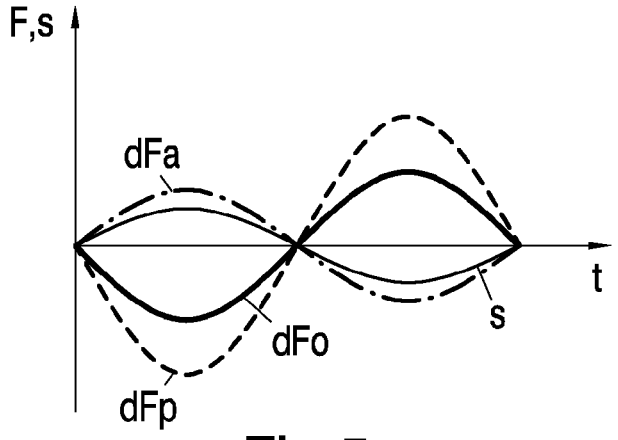
FIG. 5 shows the distance of movement of a membrane as well as the differential forces acting on it plotted against time.
Figure 6:
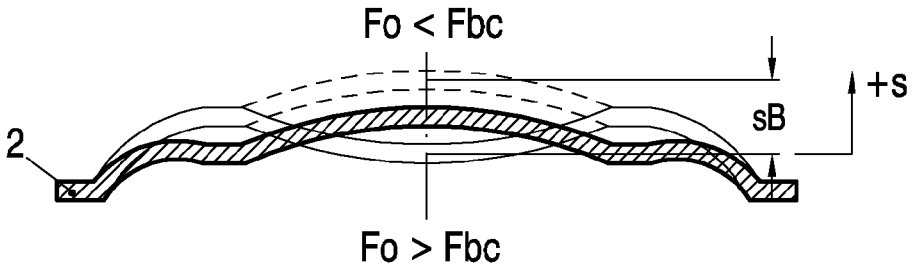
FIG. 6 shows the buckling/crinkling effect of a membrane.

Over a wide range there is no buckling or crinkling for the reference membrane (first graph sBref) until the critical reference buckling/crinkling load Fbcref is reached. A further increase of the operating loads Fo results in a dramatic increase of the buckling/crinkling amplitude sB. This critical point is also shown in FIG. 6, where the snap down of the membrane for Fo>Fbc is shown (for ease of visualization the absolute value of the buckling/crinkling amplitude sB is shown in FIG. 8). After this snapping the buckling/crinkling amplitude sB is more or less saturated, meaning that a further increase of the operating loads Fo does not result in a substantial increase of the buckling/crinkling amplitude sB.

The second graph sBinv has similar characteristics, but is shifted towards higher operating loads Fo, meaning that the critical buckling/crinkling load Fbc is much higher than the critical reference buckling/crinkling load Fbcref. Hence the membrane 2 can be operated under higher operating loads Fo, which allows to increase the sound pressure. It should be noted at this point that both membrane 2 and the reference membrane have the same shape, dimension, and stiffness (and therefore the same resonant frequency) in direction of movement MOV.

In conclusion it may be observed that the area to the left of the first graph sBref defines the area of prior art transducers which are operated with membranes of known materials. The area to the right of the first graph sBref defines the area of the invention. In between the first and second graphs sBref and sBinv is the area, wherein an inventive transducer may be operated. If the operating loads Fo exceed the critical buckling/crinkling load Fbc, again there is buckling/crinkling, degrading acoustic performance of the transducer.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A multilayer membrane for an electroacoustic transducer, the multilayer membrane comprising:

a first outer layer made of Polyarylate (PAR);

an inner layer made of adhesive on an acrylic base; and a second outer layer made of Polyarylate (PAR), wherein the inner layer is located between the first outer layer and the second outer layer, wherein a thickness of said multilayer membrane and an average Young's modulus of said multilayer membrane transversal to its extension of thickness are chosen in such a way that a critical load which causes at least part of the multilayer membrane to buckle and crinkle, is increased, compared to a single layer reference membrane made of Polycarbonate having a similar shape, dimension, and stiffness in its direction of movement.

2. The membrane of claim 1, wherein the average Young's modulus is lower and the thickness is higher than those of said single layer reference membrane.

3. The membrane of claim 1, wherein the critical load of said multilayer membrane is higher than the critical load of said single layer reference membrane.

4. The membrane of claim 1, wherein an absolute value of a difference of pressure between an environment of said electroacoustic transducer and a back volume of said transducer is higher than 600 Pa.

5. The membrane of claim 3, wherein the critical load of the multilayer membrane is 20% lower than the critical load of the single-layer reference membrane.

6. The membrane of claim 3, wherein stiffness of the multilayer membrane is 20% lower than the stiffness of the single-layer reference membrane.

7. The membrane of claim 4, wherein the absolute value of the difference of pressure between the environment of the electroacoustic transducer and the back volume of the transducer is higher than 2000 Pa.

8. The membrane of claim 7, wherein the absolute value of the difference of pressure between the environment of the electroacoustic transducer and the back volume of the transducer is higher than 6000 Pa.

* * * * *